US006242146B1

(12) United States Patent
Ishihara et al.

(10) Patent No.: US 6,242,146 B1
(45) Date of Patent: Jun. 5, 2001

(54) CARRIER FOR ELECTROSTATIC-CHARGED IMAGE DEVELOPER, DEVELOPER AND IMAGE FORMING PROCESS USING THE SAME, AND CARRIER CORE MATERIAL REPRODUCING PROCESS

(75) Inventors: Yuka Ishihara; Hiroshi Nakazawa; Akihiro Iizuka; Yoshifumi Iida; Kaori Oishi; Tomohito Nakajima; Takashi Imai; Masanori Ichimura, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/499,454

(22) Filed: Feb. 7, 2000

(30) Foreign Application Priority Data

Feb. 9, 1999 (JP) ..... 11-032017

(51) Int. Cl.[7] ..... G03G 9/113
(52) U.S. Cl. ..... 430/108; 430/137
(58) Field of Search ..... 430/106.6, 108, 430/137

(56) References Cited

U.S. PATENT DOCUMENTS 5,306,592 * 4/1994 Saha ..... 430/108
5,512,404 * 4/1996 Saha ..... 430/106.6

FOREIGN PATENT DOCUMENTS

| | | |
|---|---|---|
| 47-12286 | 6/1972 | (JP) . |
| 58-129437 | 8/1983 | (JP) . |
| 58-144839 | 8/1983 | (JP) . |
| 60-186844 | 9/1985 | (JP) . |
| 61-204646 | 9/1986 | (JP) . |
| 64-13560 | 1/1989 | (JP) . |
| 6-149132 | 5/1994 | (JP) . |
| 2-2789246 | 6/1998 | (JP) . |

* cited by examiner

*Primary Examiner*—John Goodrow
(74) *Attorney, Agent, or Firm*—Oliff & Berridge, PLC

(57) ABSTRACT

A carrier for two-component electrostatic-charged image developer, at least the surface of which is coated with a resin, is provided. The apparent density ρ (g/cm$^3$) of the carrier, the mean particle diameter D (cm) of the carrier, and the specific area S (cm$^2$/g) of the carrier core material satisfy the following conditions:

$$600 \leqq S \leqq 1500$$

$$10/(D \times \rho) - S \leqq 300.$$

A two-component developer and an image-forming process using the carrier are also provided.

13 Claims, No Drawings

CARRIER FOR ELECTROSTATIC-CHARGED IMAGE DEVELOPER, DEVELOPER AND IMAGE FORMING PROCESS USING THE SAME, AND CARRIER CORE MATERIAL REPRODUCING PROCESS

FIELD OF THE INVENTION

The present invention relates to a carrier suitable for an electrostatic-charged image developer used in an electrophotographic process, an electrostatic recording process, etc., and capable of imparting a stable electrostatic charging property, a two-component developer using it, and an image-forming process using it.

BACKGROUND OF THE INVENTION

An electrophotographic process visualizing an image information via an electrostatic latent image has been utilized in various fields at present and is known. The electrophotographic process is a process of generally forming an electrostatic latent image on a photoreceptor in an electrostatic charging/light exposure step, forming a toner image by developing the electrostatic latent image using a developer containing a toner in a development step, transferring the toner image onto a transfer material such as a paper, a sheet, etc., in a transfer step, and fixing the toner image onto the transfer material utilizing heat, a solvent, a pressure, etc., in a fixing step to obtain a permanent image.

In these electrophotographic processes, as a typical process of using a so-called two-component developer made of a mixture of a carrier and a toner, there is a magnetic brush process. In the process, particles having a magnetism, such as steel particles, ferrite particles, etc., are used as the carrier, a developer made of a toner and the magnetic carrier is carried by a magnet, and the developer is formed in a brush form by the magnetic field of the magnet. Then, by contacting the magnetic brush with an electrostatic latent image formed on a photoreceptor, the toner in the magnetic brush is attracted to the latent image according to the quantity of the electrostatic charge of the latent image, whereby the latent image is developed with the toner.

The carrier used in this case is largely classified into a coated carrier having a coating on the surface thereof and a non-coated carrier having no coating on the surface but because the coated carrier is excellent when considering the life, etc., of the developer, various coated carriers have been developed and practically used. As the characteristics of the coated carrier, it is required that proper electrostatic-charging properties (electrostatically charged amount, electrostatic charge distribution, etc.) can be given to the toner, the proper electrostatic-charging properties can be maintained for a long period of time. Accordingly, various kinds of coated carriers which do not change the electrostatic-charging properties of the toner, are excellent in the shock resistance and the corrosion resistance, and are stable to the environmental changes such as the changes of humidity, temperature, etc., have been proposed. In these carriers, carrier core materials are coated with a resin composition followed by curing to form the coated carriers having a relatively long life.

However, in the case of these carriers, these is a problem that the occurrence of lowering the charging properties by staining (impaction) of the carrier surface with the toner component cannot be prevented. To prevent the occurrence of the problem, it has been considered to form the coating of the carrier using a resin having a small surface energy such as the silicone resin as described, for example, in Japanese Patent Application Laid-Open No. 60-186844 (1985), etc., and the fluorine-based resin as described in Japanese Patent Application Laid-Open No. 1-13560 (1989). However, because in such carriers, the silicone resin or the fluorine-based resin described above exists only slightly in the thickness direction of the coating layer, there is a problem that when the developer is used for a long period of time, the effect of the resin is gradually lost by the abrasion or the like of the coating, and the impaction occurs again. Also, in the case of carrying out a continuous reproduction using such a developer, images excellent in the density regeneration and the image quality can be obtained in the beginning but after reproducing several tens of thousands copies, there are problems that the image density is lowered and the gradation and the graininess become poor.

Recently, a full-color copying machine has attracted attention and with the tendency, the necessity of satisfying the required characteristics unique to color copies different from black and white copies in related art has arisen. That is, most of the original of black and white copies are line images such as graphs, letters, etc., and the image area on a transfer material such as a paper is about 10% or less, while in the case of a full-color reproduction, since the original has a very large image area such as maps, photographs, pictures, etc., and further the portion having a gradation is large, a technique of faithfully reproducing them becomes necessary.

Moreover, in a digital-type electrophotographic full-color copying machine, from the requirement of obtaining a high image quality such as the halftone gradation and the graininess of a digital image, small sizing of toners has been proceeded and it is known that the preferred particle diameter of the toners is 9 $\mu$m or smaller.

Accordingly, for the purpose of improving the image quality, various developers have been proposed. In Japanese Patent Application Laid-Open No. 58-129437 (1983), a non-magnetic toner is proposed. Toner particles has a mean particle diameter of from 6 to 10 $\mu$m, and the particle diameters of most of the particles are from 5 to 8 $\mu$m. However, because the toner particles having particle diameters of 5 $\mu$m or smaller, which can clearly reproduce the fine dots of a latent image and be densely placed on the latent image, are 15% in number or less, there is a problem that the graininess and the gradation of the images formed become poor. Also, on the other hand, when the toner particles having the particle diameters of 5 $\mu$m or smaller are excessive, there occurs a problem that the fluidity of the toner is reduced.

Furthermore, even when the mean particle diameter of the toner and the particle size distribution of the toner particles having the particle diameters of 5 $\mu$m or smaller are proper, in the case of using a carrier in related art, good images can be obtained in the beginning, but as copying is carried out repeatedly, deterioration of images, such as the formation of fog at the non-imaged portions and the roughness of density, etc., occurs and it is difficult to repeatedly obtain the images having the required gradation and graininess. This is considered to be a phenomenon caused by that during repeating copying, only the toner which is liable to be developed is selectively consumed (called a selective phenomenon) and the toner particularly poor in the developing property remains in a developing machine.

Also, in an image pattern having a large density difference, an edge effect that only the peripheral portion of an image is emphasized occurs and an image defect that a toner does not attach to a part of the boundary of images to form a pseudo outline cannot be improved by the small-sizing of the toner alone.

Thus, in Japanese Patent Application Laid-Open Nos. 58-144839 (1983) and 61-204646 (1986), it is proposed to define the mean particle diameter and the particle size distribution of a carrier. However, these patent publications do not mention about the magnetic characteristics which greatly influence the improvement of the conveying property of the toner.

On the other hand, in Japanese Patent Application Laid-Open No. 10-2789246 (1998), the particle size distribution and the magnetic characteristics of a carrier and the particle size distribution of a toner are specifically described. However, even in the case of using the developer described in the patent publication, images excellent in the color reproducibility, the gradation, and the graininess are obtained in the beginning, but as copying is carried out repeatedly, lowering of the image quality due to the pseudo outline and the edge effect is arisen and the use of the developer is insufficient to attain the desired image quality.

Now, when continuous copying is carried out using such a developer, images excellent in the density reproducibility and the image quality can be obtained for a long period of time but a deterioration proceeds to some extent with the passage of time. In general, in the case of using a developer wherein staining of a carrier proceeds, the deterioration of image quality proceeds gradually, and hitherto, such a developer is recovered and disposed of. However, recently, environmental disruption by industrial wastes has become a problem and the regeneration of developers becomes one of the issues to resolve. With regard to the regeneration of developers, in Japanese Patent Application Laid-Open No. 47-12286 (1972), for example, a method of regenerating by heating a recovered developer at a high temperature (about 1000° F.) is proposed but the high-temperature treatment may have an effect for removing the coating but has the fault that electric characteristics, etc., cannot be regenerated. Also, in Japanese Patent Application Laid-Open No. 6-149132 (1994), a method of removing the stain of a carrier without damaging the coating layer of the carrier surface by the combination with a thermally decomposable toner is proposed but the method can be applied only to the carrier using a specific coating material and is lacking in a general use.

SUMMARY OF THE INVENTION

Thus, the present inventors have investigated a method of regenerating the carrier core material of an electrostatic-charged two-component developer without damaging the characteristics of the developer.

The present invention has been made as the results of the above-described investigations and provides a carrier, which can impart an electrostatic charging property that is stable with passage of time to a developer and is suitable for an electrostatic charge developer causing neither fog nor lowering of density even after copying has been carried out repeatedly, a two-component developer using the carrier, and an image-forming process using the developer. In particular, the invention provides a carrier and a developer suitable for a color image formation which is stable in the density reproducibility and does not generate a toner spent in a developing machine even when continuous copying of an original having a large image area, such as photographs and pictures.

Moreover, the invention provides a process of regenerating a carrier core material for an electrostatic-charge developer capable of imparting an electrostatic charging property that is stable with passage of time to a developer without degrading the characteristics thereof.

As the result of various investigations for solving the above-described problems in the techniques of related art, the present inventors have found that a core material having specific characteristics is suitable for the carrier of a two-component developer and have also found that by using the carrier, a developer capable of keeping a stable electrostatic charging property can be obtained, and have accomplished this invention.

That is, according to an aspect of this invention, a carrier for an electrostatic charge developer is a carrier for a two-component developer, at least the surface of which is coated with a resin. The apparent density ρ (g/cm$^3$) and the mean particle diameter D (cm) of the carrier and the specific area S (cm$^2$/g) of the carrier core material satisfy the following condition:

$$600 \leqq S \leqq 1500$$

$$10/(D \times \rho) - S \leqq 300.$$

Also, it is preferable that the mean particle diameter of the carrier is from 30 to 45 μm, the saturation magnetization to an applied magnetic field of 1000 Oe (Oersted) is from 50 to 65 emu/g, the residual magnetization is not larger than 3 emu/g, the coercive force is not larger than 12 Oe, and the sphere-converted specific area $S_{co}$ (m$^2$/g) of the particle diameter of the carrier core material and the EET surface area $S_{ca}$ (m$^2$/g) of the core material satisfy the following condition:

$$0.057 \leqq S_{ca} - S_{co} \leqq 0.097.$$

The two-component developer according to another aspect of this invention is a two-component developer containing at least a carrier the surface of which is coated with a resin and a toner. As the carrier, the above-described carrier for an electrostatic charge developer is used. A particle size distribution of the toner used for the carrier is that the number of toner particles having a particle diameter of not more than 4 μm is approximately from 6 to 25% of the total number of toner particles, and the amount of toner particles having a particle diameter of not less than 16 μm is approximately not more than 1 volume %. The volume mean diameter of the toner is from 5 to 9 μm.

In this case, it is preferred that the electric resistance of the core material of the carrier is from $10^{7.5}$ to $10^{9.5}$ Ω cm from the viewpoint of the stability of the image quality with the passage of time, and also it is preferred that resin particles and/or electrically conductive particles are dispersed in the coating resin of the carrier from the view point of the electrostatic charge imparting property and the durability.

Furthermore, it is preferred that the toner particles contain inorganic oxide fine particles having a BET specific area of from 40 to 250 m$^2$/g.

The image-forming process of this invention has a step of forming a latent image on a latent image carrier and a step of developing the latent image using a developer on a developer holding member. As the developer, the above-described two-component developer is used. In the case of using the process for the formation of color images, the above-described two-component developer may be used as at least one of plural developers each having a different hue.

The present invention also provides a process of regenerating a carrier core material made of a magnetic substance the surface of which is coated with a resin. The process has a 1st step of removing the coating layer by burning the carrier at a combustion temperature of from 500° C. to 1300° C. and a 2nd step of controlling so that the core characteristics become the definite core characteristics again by firing the carrier at a firing temperature of from 500° C. to 1300° C. in an oxygen atmosphere while controlling the concentration of the oxygen atmosphere.

DETAILED DESCRIPTION OF THE INVENTION

The invention is described in detail hereinbelow.

As the result of the investigations on the influences of the particle size distribution, the surface property, the specific area, and the apparent density of a carrier to the conveying property and the image quality of a small-sized toner, the inventors have found that they have a correlation with the image quality. The apparent density and the specific area of the carrier are also influenced by the composition and the coating amount of a resin coating the carrier surfaces but in this invention, the apparent density ρ (g/cm$^3$) and the mean particle diameter D (cm) of the carrier, and the specific area S (cm$^2$/g) of the carrier core material are required to have the relation of satisfying the following formula 1;

$$600 \leqq S \leqq 1500$$

$$10/(D \times \rho) - S \leqq 300 \qquad 1.$$

When the specific area (S) of the carrier core material is smaller than 600, the conveying property of the toner is degraded to cause the deterioration of the graininess and the gradation of the image formed. Also, when the specific area is larger than 1500, the fluidity of the developer is deteriorated and there is a possibility of causing the roughness of density, etc.

In this invention, when the left side value of the formula 1 exceeds 300, not only the charge-imparting property to the toner becomes insufficient but also the inconvenience that the electric resistance characteristics necessary for regenerating a fine image become hard to control occurs. Also, because the carrier itself becomes liable to be released from the carrier holder, the developer is applied to the photoreceptor, thereby a problem that the portion only appears as unfilled spots on an image formed occurs.

Also, as the result of investigating the influences of the particle size distribution of the carrier, the surface property (or the specific area) of the carrier core material, and the magnetic characteristics of the carrier onto the conveying property and the image quality of the small-sized toner, the inventors have further found that the magnetic characteristics, etc., of the carrier have a correlation with the image quality. In this invention, it is preferred that the mean particle diameter of the carrier is from 30 to 45 μm in addition to the characteristics described above. When the mean particle diameter is smaller than 30 μm, the fluidity of the developer is deteriorated and there is a possibility of forming roughness of density, etc., and when the mean particle diameter is larger than 45 μm, a sufficient effect may not be obtained for the conveying property of the small-sized toner which is necessary for attaining a high image quality.

The magnetic characteristics of the carrier greatly influence the developing characteristics and the conveying property of the developer but at the same time they are influenced by a magnetic roller contained in a developer holder. In this invention, in the case of developing by fixing a magnetic roller onto a developer holder and circularly conveying the developer by rotating the developer holder as a single body, when the magnetic roller is a penta-pole structure having repulsion poles, the magnetic flux density in the developing region is from 900 to 1450 gausses, and the saturation magnetization of the carrier is from 50 to 65 emu/g, the particularly excellent effects are obtained in the graininess and the gradation of the images formed. When the saturation magnetization is larger than 65 emu/g (to the applied magnetic field of 1000 Oe), the rising state of the magnetic brush formed by the carrier and the toner on the developer holder becomes hard, whereby the toner becomes hard to be carried on the electrostatic latent images on a photoreceptor in a developing region. On the other hand, when the saturation magnetization is less than 50 emu/g, according to the conditions that the developer holder becomes small size and also the peripheral speed of the developer holder becomes fast, it becomes difficult to hold well the developer on the holder to cause scattering off of the carrier, thereby unfilled spots may appear on the image formed. Furthermore, when the residual magnetization and the coercive force of the carrier are too high, the conveying property of the developer is disturbed and with degrading of the developing property, the image defects such as the roughness of the solid black image, the ununiformity of density, etc., are liable to occur. Accordingly, in the reproduction required to have a high image density and also the good raininess and gradation, to keep the good developing property, it is preferred that the residual magnetization of the carrier is not larger than 3 emu/g and the coercive force is not larger than 12 Oe (to the applied magnetic field of 1000 Oe).

The specific area of the carrier core material is influenced by the core composition and the calcinating condition but in this invention, it is a preferred embodiment that the sphere-converted specific area $S_{co}$ (m$^2$/g) of the particle size of the carrier core material and the EET specific area $S_{ca}$ (m$^2$/g) of the core material satisfy the relation of the following formula;

$$0.057 = S_{ca} \cdot S_{co} \leqq 0.097.$$

When $S_{ca} \cdot S_{co}$ is smaller than 0.057, the conveying property of the toner is degraded to cause a possibility of deteriorating the graininess and the gradation of the image formed. Also, $S_{ca} - S_{co}$ is larger than 0.097, the fluidity of the developer is deteriorated and thus, there is a possibility of causing the roughness of density or the like.

In this invention, it is preferred that the electric resistance of the carrier core material is from $10^{7.5}$ to $10^{9.5}$ Ω cm. When the electric resistance is lower than $10^{7.5}$ Ω cm, in the case of reducing the toner concentration in the developer by repeated copying, an electrostatic charge injects into the carrier, thereby the carrier itself may be developed. On the other hand, when the electric resistance is higher than $10^{9.5}$ Ω cm, bad influences are given to the image quality such as the occurrences of the striking edge effect, the pseudo outline, etc.

In this invention, there is no particular restriction on the core material of the carrier as far as the above-described condition is satisfied. Examples of the core material include magnetic metals such as iron, steel, nickel, cobalt, etc.; alloys of these metals and manganese, chromium, rare earth elements, etc.; and magnetic oxides such as ferrite, magnetite, etc., but from the viewpoint of using a magnetic brush method, the carrier is preferably a magnetic carrier. Examples of the carrier core material suitably used in this invention include alloys of ferrite and manganese, lithium, strontium, magnesium, etc.

The present inventors have found an unexpected fact that the core material used for the carrier having the characteristics as described above, that is, the core material having formed on the surface thereof fine unevenness is more preferred than a core material having a sphere form, and the carrier core material having such a fine unevenness on the surface thereof can be obtained by a known method.

That is, first, definite amounts of a metal oxide, iron oxide ($Fe_2O_3$) and additive(s) are mixed. The mixture obtained is calcined at a temperature of from 800 to 1000° C. for from 0.5 to 5 hours and thereafter, the calcined mixture is ground into particle diameters of from about 0.3 to 3 μm. Then the ground product is added with a binder as required, granulated by spray drying under a heating atmosphere of from 100 to 200° C., and thereafter, the granules obtained are sintered at a sintering temperature of from 1,000 to 1,500° C. for from 1 to 24 hours, whereby crystal particles having particle diameters of from about 1 to 50 μm are obtained. Then, the sintered ferrite particles are heat-treated. By the heat treatment, many fine unevenness can be formed on the surfaces of the crystal particles constituting the ferrite particles. The heat treatment is carried out by allowing to stand the ferrite particles under an inert gas (e.g., an $N_2$ gas, etc.) atmosphere of an oxygen concentration of not higher than 5%, and preferably not higher than 2%, at a temperature of from 750 to 1,200° C., and preferably from 800 to 1150° C., for from 0.5 to 3 hours, or while flowing an inert gas by a rotary kiln, etc.

The carrier in this invention is coated on the surface of the core thereof with a resin and there is not particular restriction on the resin if the resin can b used as a matrix resin, and the resin can be properly selected according to the purpose. Examples of the resin used include known resins, for example, polyolefin-based resins such as polyethylene, polypropylene, etc., polyvinyl-based resins and polyvinylidene-based resin such as polystyrene, an acrylic resin, polyacrylonitrile, polyvinyl acetate, polyvinyl alcohol, polyvinyl butyral, polyvinyl chloride, polyvinyl carbazole, polyvinyl ether, polyvinyl ketone, etc.; a vinyl chloride-vinyl acetate copolymer; a styrene-acrylic acid copolymer; a straight silicone resin made of an organosiloxane bond or the modified products thereof: fluorine-based resins such as polytetrafluoroethylene, polyvinyl fluoride, polyvinylidene fluoride, polychlorotrifluoroethylene, etc.; silicone resins; polyesters; polyurethane; polycarbonate; phenol resins; amino resins such as a urea-formaldehyde resin, a melamine resin, a benzoguanamine resin, a urea resin, a polyamide resin, etc.; epoxy resin, etc. They may be used singly or as a mixture of two or more kinds of them. In this invention, in these resins, the use of at least the fluorine-based resins and/or the silicone resins is preferred. When the fluorine-based resin and/or the silicone resin is used, it is advantageous in the point that it is highly effective in preventing the occurrence of the stain (impaction) of the carrier with the toner and external additives.

In the carrier of this invention, from the viewpoint of the preferred electric properties described above, it is preferred that the coating amount with the above-described resin is from 1.5 to 3.0%. It is known that when the coating amount is less than 1.5%, the core material of the carrier is exposed from the resin coating layer and there is a possibility of giving bad influences on the developing property, and when the coating amount exceeds 3.0%, there is a tendency of increasing the electric resistance of the developer. According to the past knowledge, the electric resistance of the developer is a large control factor to the gradation and the occurrence of edge effect and as the electric resistance of a developer is higher, the deterioration of images, such as deterioration of the gradation, occurrence of the edge effect or the like are induced. According to the inventors' investigations, when the coating amount of the resin on the carrier exceeds 3%, the occurrence of the image deterioration as described above becomes severe, accordingly the preferred coating amount of the resin for obtaining both the good developing property and the good image quality is from 1.5 to 3.0%.

It is preferred in this invention that in the coating layer with the resin described above, resin particles and/or electrically conductive particles are dispersed in the resin.

As the resin particles, there are thermoplastic resin particles, thermosetting resin particles, etc. In these resins, from the viewpoint of easily increasing the relative hardness, the thermosetting resin is preferred, and from the viewpoint of imparting a negative charging property to the toner, the resin particles of a nitrogen-containing resin are preferred. These resins may be used singly or as a mixture of two or more kinds of them.

The mean particle diameter of the resin particles is preferably from about 0.1 to 2 $\mu$m, and more preferably from 0.2 to 1 $\mu$m. When the mean particle diameter of the resin particles is less than 0.1 $\mu$m, the dispersibility of the resin particles in the coating resin layer becomes very bad, while when the mean particle diameter exceeds 2 $\mu$m, the resin particles are liable to be released from the coating layer and thus, the desired effect may not be obtained.

Also, the electrically conductive particles described above include metal particles of gold, silver, copper, etc.; carbon black particles; particles of semiconductor oxides such as titanium oxide, zinc oxide, etc.; and the powders of titanium oxide, zinc oxide, barium sulfate, aluminum borate, potassium titanate, etc., the surface of which are coated with tin oxide, carbon black, a metal, etc. They may be used singly or as a mixture of two or more kinds of them.

In these electrically conductive particles, from the points of the production stability, the low cost, the good conductivity, etc., carbon black particles are preferred. There is no particular restriction on the kind of the carbon black used in this invention but carbon black having a DBP oil absorption of from about 50 to 250 ml/100 g is preferred in the point of the excellent production stability.

There is no particular restriction on the method of forming a coating on a carrier core material, and for example, there is a method of using a coating liquid for forming coating containing resin particles such as crosslinking resin particles and/or electrically conductive particles, and a matrix resin such as a styrene-acrylic resin, a fluroine-based resin, a silicone resin, etc., in a solvent.

Specifically, there are, for example, a dipping method of dipping the carrier core material in the above-described coating liquid for forming coating, a spray method of spraying the coating liquid for forming coating on the surface of the carrier core material, a kneader-coater method of mixing the carrier core material with the coating liquid for forming coating in the state of floating by flowing air, etc. In these methods, the kneader-coater method is preferred in the invention.

There is no particular restriction on the solvent used for the coating liquid for forming coating if as far as the solvent can dissolve the matrix resin only and the solvent can be properly selected from known solvents. Examples of the solvent include aromatic hydrocarbons such as toluene, xylene, etc.; ketones such as acetone, methyl ethyl ketone, etc.; and ethers such as tetrahydrofuran, dioxane, etc.

When the resin particles are dispersed in the coating of the carrier core material, because the resin particles and the matrix resin are uniformly dispersed in the thickness direction and the tangential direction of the carrier surface, even when the carrier is used for a long period of time and the surface of the coating is abraded, the surface property can be always maintained at the same state as the unused state and a good charge-imparting property to the toner can be maintained for a long period of time. Also, when the electrically conductive particles are dispersed in the resin coating, because the electrically conductive particles and the matrix resin are uniformly dispersed in the thickness direction and the tangential direction of the carrier surface, even when the carrier is used for a long period of time and the coating is abraded, the surface property same as the unused state can be always maintained, whereby the deterioration of the carrier can be prevented for a long period of time. In addition, when the resin particles and the electrically conductive particles are dispersed in the coating, the above-described effects can be simultaneously obtained.

The two-component developer of this invention gives effective results by combining the specific carrier described above and the specific toner described hereinbelow.

With regard to the particle size distribution of toner in this invention, the toner particles having the particle diameters of not larger than 4 $\mu$m are preferably from 6 to 25% in number, and more preferably from 6 to 16% of the total toner particle number. When the toner particles having the particle diameters of not larger than 4 $\mu$m are less than 6% in number, the number of the toner particles contributing the reproducibility of fine dots and the graininess is less and since such particles are selectively consumed because of the effective particle sizes, when copying is repeatedly carried out, only the toner particles of the particle sizes which are hard to contribute to the development remain in the developing machine, whereby the image quality is deteriorated with the passage of time. On the other hand, when the number of such toner particles exceeds 25%, the fluidity of the toner worsens, whereby the conveying property of the developer is degraded and there is a possibility of giving bad influence on the developing property.

Also, the toner particles having the particle diameters of at least 16 $\mu$m are preferably not more than 1.0% by volume. When such toner particles are contained more than 1.0% by volume, not only they give bad influences on the reproducibility of fine lines and the gradation but also at transferring, the coarse toner particles having the particle diameters of at least 16 $\mu$m are exist in the toner layer and they act to prevent the electrostatic sticking state of the photoreceptor and the transfer material, whereby it is possible to lower the transferring efficiency and thus to lower the image quality.

Also, the volume mean diameter of the toner is preferably from 5 to 9 $\mu$m and this is the indispensible characteristics for reproducing a high image quality together with the above-described particle diameter distribution. When the volume mean particle diameter is smaller than 5 $\mu$m, not only the fluidity of the toner worsens but also sufficient electrostatic charges are hard to be imparted from the carrier, whereby a fog occurs at the background portions and the density reproducibility is liable to be degraded. On the other hand, when the volume mean diameter exceeds 9 $\mu$m, the above-described characteristics of the carrier cannot be sufficiently obtained and the improvement effects of the reproducibility of fine dots, the gradation, and the graininess become poor.

Accordingly, by having the particle size distribution of toner described above, even in repeated copying of an original having a large image area and a density gradation, such as photographs, pictures, pamphlets, etc., a faithful reproducibility can be expected for the dots of fine latents images.

On the other hand, by small-size toner, there is a possibility of causing the following problems. That is, (1) as the sticking force among the toner particles increases, the toner particles are liable to be aggregated. (2) The amount of electrostatic charges by frictional electric charge is increased. (3) Because the contacting possibility with the carrier is increased, there is a problem that the carrier is liable to be stained and deteriorated. Thus, recently, by adding inorganic oxide fine particles having high added values such as a fluidity-imparting property, a charge-controlling faculty, etc., to the toner, an effect is obtained and in these inorganic oxide fine particles, the inorganic oxide fine particles having a BET specific area in the range of from 40 to 250 $m^2/g$ are preferred, and more preferred range of the BET specific area is from 80 to 200 $m^2/g$. When BET specific area of the inorganic oxide fine particles added is larger than 250 $m^2/g$, it is effective for the improvement of the fluidity but the attaching state on the toner becomes hard to control and at the same time the fine particles are liable to be imbedded in the surface of the toner, whereby the toner is liable to be deteriorated. Also, when the specific area is less than 40 $m^2/g$, not only fluidity imparting is insufficient but also there are possibilities that filming and scratches onto the surface of the photoreceptor are induced and when the toner is used as the toner for color, transparency of the OHP image is degraded.

Examples of the inorganic oxide fine particles added to the toner include $SiO_2$, $TiO_2$, $Al_2O_3$, CuO, ZnO, $SnO_2$, $CeO_2$, MgO, SaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, etc. In these fine particles, silica fine particles and titania fine particles are particularly preferred. It is preferred that the surfaces of the oxide fine particles are previously subjected to a hydrophobic treatment. The hydrophobic treatment is effective for the improvement of the fluidity of the toner powders and also for the improvement of the environmental reliance of electrostatic charging and the staining resistance of the carrier.

The hydrophobic treatment can be carried out by dipping the inorganic oxide in a hydrophobic treating agent, etc. There is no particular restriction on the hydrophobic treating agent, but there are, for example, a silane coupling agent, a silicone oil, a titanate-based coupling agent, an aluminum-based coupling agent, etc. They may be used singly or as a mixture of two or more kinds thereof. In these agents, the silane coupling agent is preferred.

As the silane coupling agent, for example, chlorosilane, alkoxy silane, silazane, special silylating agent, etc., can be used. Specific examples of the silane coupling agent include methyl trichlorosilane, dimethyl dichlorosilane, trimethyl chlorosolane, phenyl trichlorosilane, diphenyl dichlorosilane, tetramethoxysilane, methyl trimethoxysilane, dimethyl dimethoxysilane, phenyl trimethoxysilane, diphenyl dimethoxysilane, tetraethoxysilane, methyl triethoxysilane, dimethyl diethoxysilane, phenyl triethoxysilane, diphenyl diethoxysilane, isobutyl triethoxysilane, decyl trimethoxysilane, hexamethyl disilazane, N,O-(bistrimethylsilyl)acetamide, N,N-(trimethylsilyl)urea, tert-butyl dimethylchlorosilane, vinyl trichlorosilane, vinyl trimethoxysilane, vinyl triethoxysilane, γ-methacryloxypropyl trimethoxysilane, β-(3,4-epoxycyclohexyl)ethyl trimethoxysilane, γ-glycidoxypropyl trimethoxysilane, γ-glycidoxypropylmethyl diethoxysilane, γ-mercaptopropyl trimethoxysilane, γ-chloropropyl trimethoxysilane, etc.

The amount of the hydrophobic agent differs according to the kind of the inorganic oxide fine particles, etc., and cannot be generally defined but the amount is usually from 5 to 50 parts by weight to 100 parts by weight of the inorganic oxide fine particles.

The toner particles used for the two-component developer of this invention contain a binder resin and a coloring agent as the main constituents.

Examples of the binder resin include the homopolymers or copolymers of monoolefins such as ethylene, propylene, butylene, isoprene, etc.; vinyl esters such as vinyl acetate, vinyl propionate, vinyl benzoate, vinyl butyrate, etc.; α-methylene aliphatic monocarboxylic acid esters such as methyl acrylate, phenyl acrylate, octyl acrylate, methyl methacrylate, ethyl methacrylate, butyl methacrylate, dodecyl methacrylate, etc.; vinyl ethers such as vinyl methyl ether, vinyl ethyl ether, vinyl butyl ether, etc.; vinyl ketones such as vinyl methyl ketone, vinyl hexyl ketone, vinyl isopropenyl ketone, etc. In these polymers or copolymers, typical examples of the binder resin include polystyrene, a styrene-alkyl acrylate copolymer, a styrene-butadiene copolymer, a styrene-maleic anhydride copolymer, polypropylene, etc. Furthermore, there are polyesters, polyurethane, an epoxy resin, a silicone resin, polyamide, denatured rosin, etc.

There is no particular restriction on the coloring agent used in this invention and examples of the coloring agent include carbon black, Aniline Blue, Chalcoyl Blue, Chrome Yellow, Ultramarine Blue, Du Pont Oil Red, Quinoline Yellow, Methylene Blue Chloride, Phthalocyanine Blue, Malachite Green Oxalate, lamp black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, Pigment Blue 15:3, etc.

In addition, the toner in the invention can contain a charge controlling agent as required. In this case, especially in the case of using for color toners or the like, a colorless or faint color charge controlling agent giving no influence on the hue is preferred. As the charge controlling agent, known agents can be used, but the use of azo-based metal complexes, metal complexes of salicyclic acid or an alkylsalicyclic acid, or metallic salts is preferred. Also, the toner can further contain an offset preventing agent such as a low-molecular weight propylene, low-molecular weight polyethylene, wax, etc., and other known components.

Because the two-component developer of this invention obtained by combining the carrier of this invention and the above-described preferred toner can keep a stable electrostatic charging property, when the developer is repeatedly used, the image-forming property is hard to be degraded and can form good images for a long period of time. The biggest feature of the image-forming process of this invention is that the process is carried out using the two-component developer as described above.

Particularly, in the case of forming color images, because the toner development corresponding plural hues is carried out with fine toner particles, an edge effect is liable to occur, but since the developer of the invention can keep a stable charging property for a long period of time, the developer can be suitably used for such a color image-formation.

In the case of forming color images, when the two-component developer of this invention is used as at least one developer in plural hues, a desired effect can be obtained but by using the developers of the invention as the developers of all hues, the effect is remarkable.

Now, in the case of carrying out continuous copying using such developers, images having excellent density reproducibility and image quality can be obtained for a long period of time but with the passage of time a deterioration proceeds to some extent. In general, in the developer wherein staining of the carrier is proceeded, the deterioration of image quality proceeds gradually, and hitherto such a developer is recovered and disposed of. However, recently, environmental disruption by industrial wastes has become a problem and the regeneration of developers has become one of the issues to resolve. The present inventors investigated a method of regenerating the carrier core material of the electrostatic-charge image two-component developer without degrading the developer characteristics.

The carrier core material regeneration method of this invention is a method of regenerating the carrier core material made of a magnetic substance, the surface of which is coated with a resin. The method has a 1st step of removing the coating layer by burning the carrier at a combustion temperature of from 500° C. to 1300° C. and a 2nd step of firing at a firing temperature of from 500° C. to 1300° C. while controlling the concentration of an oxygen atmosphere so that the desired core material characteristics are obtained again.

The inventors have found that the stained carrier core material of the electrostatic-charged image two-component developer can be regenerated by the method.

In the 1st step, the purpose is to remove the coating layer, and the temperature condition, the combustion time, etc., are properly selected according to the property of the resin used for the coating layer, the thickness of the coating layer, etc. In most cases, the carrier is burned at a temperature of from 500 to 800° C. for about 2 hours.

Also, the firing temperature and the oxygen atmosphere in the 2nd step are properly selected according to the property of the carrier core material. For example, in the case of using ferrite as the core material, in order not to degrade the magnetism, the firing temperature is preferably from 700 to 1300° C.

In both the 1st step and the 2nd step, when the burning or firing temperature is lower than 500° C., the removal of the coating layer becomes insufficient and the charging characteristics after re-coating are influenced. Also, when the temperature is higher than 1300° C., the core material is melted, whereby re-granulation must be carried out.

Also, the oxygen atmosphere concentration is preferably controlled to the range of from 0.1 to 20%, and more preferably to the range of from 1 to 5%. When the burning in the 2nd step is carried out in the air without controlling the oxygen atmosphere concentration, the desired core material characteristics, in particular, the core material surface property, the core material resistance, etc., cannot be obtained.

In the generation method, first, the toner and the carrier of the deteriorated developer are separated from each other. In this case, there is no particular restriction on the separation method, they can be separated by a method of blow off, an air classification, water washing, etc. The separated stained carrier may be regenerated by the above-described method.

As far as the above-conditions are satisfied, as the regenerated core material of the carrier, for example, a magnetic metal such as iron, copper, nickel, cobalt, etc.; alloys of these metals with manganese, chromium, rare earth elements, etc.; magnetic oxides such as ferrite, magnetite, etc., can be applied in this invention.

That is, the regeneration method of carrier core material of this invention can be applied to the carriers of all the known developers but, particularly, when the regeneration method is used for a carrier having a special form and specific magnetic characteristics such as the carrier of the electrostatic charge developer of this invention, it is preferred from the viewpoint not only of the regeneration effect but also of the economy, etc.

Then, measurement methods of the properties defined in the invention are described.

(1) BET Specific areas of carrier and carrier core:

As the measurement apparatus of the BET specific area of the carrier, an SA3100 specific area/pore measurement apparatus (manufactured by Coulter Company) is used. A measuring sample is placed in a measurement cell in an amount of from about 15 to 20 g and the weight thereof is precisely measured by precision balance. Thereafter, vacuum suction heat treatment is carried out at 200° C. for 30 minutes at a degassing port attached to the apparatus. Then, the sample is set to a measurement port, the program "BET5" of the apparatus is selected, and the measurement is initiated. The measurement is automatically carried out, and after finishing the measurement, when the weight is inputted, the BET surface area is automatically calculated.

(2) Apparent density:

The apparent density of the carrier is measured according to JIS Z2504.

(3) Electric resistance of carrier core material:

As the electric resistance measuring apparatus of a carrier core material, an SM 8210 Type Super Mega Ohm Meter (manufactured by Toa Denpa Kogyo) is used. As a measurement environment, the measurement is carried out at a temperature of 23±2° C. and 58±5% RH.

The measurement procedure is shown below.

A sample is precisely measured by an electronic balance at 200 mg and the sample is seasoned under the measurement condition for at least one hour.

After putting on the electric supply of the mega ohm meter and charging for at least 30 minutes, the calibration of the apparatus is carried out to complete the measurement preparation.

The sample weighed and seasoned is inserted between measuring electrodes with a gap of 6.5 mm and magnets of 1500 gausses are mounted at the left and right sides of the electrodes. After mounting the magnets, they are moved vertically 5 times so that the sample has no bias between the electrodes.

After confirming that the voltage of the mega ohm meter is 1000 V and the range is CAL, the electrodes are connected to the measurement terminals.

Charging and discharging switch is set to discharge after charging for 5 seconds, the switch is set to MEASURE. A range is selected so that the needle indicates an appropriate scale from CAL, and the value after 10 seconds since MEASURE is read. The common logarithm (log) of the read value is defined as the resistance value of the sample.

(4) Magnetic characteristics of carrier:

As the apparatus of measuring the magnetic characteristics of a carrier, a vibration sample type magnetic measurement apparatus, VSM P10-15 (manufactured by Toei Kogyo) is used. A measuring sample is filled in a cell having an inside diameter of 7 mm and a height of 5 mm and set in the apparatus.

At the measurement, a magnetic field is applied and swept to 1000 Oe at the maximum. Then, the applied magnetic field is reduced and a hysterics curve is prepared on a recording paper. From the data of the curve, the saturated magnetization, the residual magnetization and the coercive force are obtained.

Then, the invention is described by the examples but the invention is not limited to these examples. In addition, all parts in the following explanation are by weight, unless otherwise indicated.

Production of toner particles A:

| | |
|---|---|
| Polyester resin | 100 parts |
| Pigment Blue 15:3 | 4 parts |

The above-described components are sufficiently premixed by a Henschel mixer, melt-kneaded by a twin-screw type roll mill, after cooling, the kneaded product is finely ground by a jet mill, then a classification is carried out twice by an air-classifier to produce toner particles (cyan toner) having a mean particle diameter of 6.5 $\mu$m, 12% in number of toner particles having particle diameters of not larger than 4 $\mu$m, and 0.5 volume % of toner particles having particle diameters of at least 16 $\mu$m.

By mixing 100 parts of the toner particles and 0.6 part of hydrophobic titanium oxide fine particles having a BET specific area of 100 $m^2/g$ as an external additive by a Henschel mixer, toner particles A are prepared.

Production of toner particles B:

By following the same procedure as the production of the toner particles A except that hydrophobic silica having a BET specific surface of 260 $m^2/g$ is used in place of the hydrophobic titanium oxide fine particles having a BET surface area of 100 $m_2/g$ in the production of the toner particles A, toner particles B are prepared.

The characteristics of the toner A and the toner B are shown in Table 1 below.

TABLE 1

| | Particle size distribution | | | External additive | |
|---|---|---|---|---|---|
| Toner | Mean particle diameter ($\mu$m) | ≦4 $\mu$m (% in number) | ≧18 $\mu$m (Volume %) | Kind | BET specific area |
| A | 6.5 | 12 | 0.5 | Hydrophobic titanium oxide | 100 |
| B | 6.5 | 12 | 0.5 | Hydrophobic silica | 260 |

Production of carrier A:

| | |
|---|---|
| Ferrite particles (specific area 1000 $cm^2/g$, core material electric resistance $10^{7.85}$ Ω cm) | 100 parts |
| Toluene | 14 parts |
| Perfluorooctylethyl acrylate/methyl methacrylate copolymer (copolymerization ratio 40:60, Mw = 50,000) | 0.6 part |
| Styrene-methyl methacrylate copolymer (copolymerization ratio 20:80, Mw = 50,000) | 1.2 parts |
| Carbon black (VXC-72, made by Cabot Co.) | 0.12 part |
| Crosslinked melamine resin (mean particle diameter: 0.3 $\mu$m) | 0.3 part |

The above components excluding the ferrite particles are dispersed by a stirrer for 10 minutes to prepare a liquid for forming coating, the liquid for forming coating and the ferrite particles are placed in a vacuum degassing type kneader, and after stirring for 30 minutes at 60° C., toluene is distilled off by reducing pressure to form a coating on the surfaces of the ferrite particles, thereby a carrier is obtained.

The coating of the obtained carrier is uniformly dispersed with the carbon black and the crosslinked melamine resin particles. Because the coating material contains the styrene-methacrylate copolymer and the perfluorooctylethyl acrylate copolymer as matrix resins which are pre-dispersed with the carbon black particles and the crosslinked melamine resin particles by diluting with toluene by a sand mill.

Production of Carrier B

By the same procedure as the case of the carrier a except that the ferrite particles in the production of the carrier A are replaced with particles having a specific area of 940 $cm^2/g$ and a core material electric resistance of $10^{9.61}$ O m, coating is formed to obtain carrier particles B.

Production of carrier C:

| | |
|---|---|
| Ferrite particles (specific area 985 $cm^2/g$, core material electric resistance $10^{8.2}$ Ω cm) | 100 parts |
| Toluene | 14 parts |
| Perfluorooctylethyl acrylate/methyl methacrylate copolymer (copolymerization ratio 40:60, Mw = 50,000) | 1.6 parts |
| Electrical-conductive particles (S-1: made by Mitsubishi Material, $SnO_2$) | 0.12 part |
| Crosslinked methyl methacrylate resin (mean particle diameter: 0.3 $\mu$m) | 0.3 part |

The above components excluding the ferrite particles are dispersed by a stirrer for 10 minutes to prepare a liquid for forming coating, the liquid for forming coating and the ferrite particles are placed in vacuum degassing type kneader, after stirring for 30 minutes at 60° C., toluene is distilled off at a reduced pressure to form a coating on the surfaces of the ferrite particles, thereby a carrier is obtained.

The coating of the obtained carrier is uniformly dispersed with the carbon black and the crosslinked methyl methacrylate resin particles. Because the coating material contains the perfluorooctylethyl acrylate copolymer as a matrix resin which is pre-dispersed with the carbon black particles and the crosslinked methyl methacrylate resin particles by diluting with toluene by a sand mill.

| Production of carrier D: | |
|---|---|
| Ferrite particles (specific area 750 $cm^2/g$, core material electric resistance $10^{8.0}$ Ω cm) | 100 parts |
| Toluene | 14 parts |
| Perfluorooctylethyl acrylate/methyl methacrylate copolymer (copolymerization ratio 40:60, Mw = 50,000) | 1.2 parts |
| Electric-conductive particles (Pastran-Type IV; made by Mitsui Mining & Smelting, barium sulfate particles coated with tin oxide) | 0.12 part |
| Crosslinked nylon resin (mean particle diameter: 0.3 μm) | 0.3 part |

The above components excluding the ferrite particles are dispersed by a homomixer for 10 minutes to prepare a liquid for forming coating, the liquid for forming coating and the ferrite particles are placed in vacuum degassing type kneader, after stirring for 30 minutes at 60° C., toluene is distilled off at a reduced pressure to form a coating on the surfaces of the ferrite particles, thereby a carrier is obtained.

The coating of the obtained carrier is uniformly dispersed with the carbon black and the crosslinked nylon resin particles. Because the coating material contains the perfluorooctylethyl acrylate copolymer as a matrix resin which is pre-dispersed with the carbon black particles and the crosslinked nylon resin particles by diluting with toluene by a sand mill.

| Production of carrier E: | |
|---|---|
| Ferrite particles (specific area 340 $cm^2/g$, core material electric resistance $10^{7.9}$ Ω cm) | 100 parts |
| Toluene | 14 parts |
| Perfluorooctylethyl acrylate/methyl methacrylate copolymer (copolymerization ratio 40:60, Mw = 50,000) | 1.6 parts |
| Carbon black (VXC-72, made by Cabot Co.) | 0.12 part |
| Crosslinked melamine resin (mean particle diameter; 0.3 μm) | 0.3 part |

The above components excluding the ferrite particles are dispersed by a stirrer for 10 minutes to prepare a liquid for forming coating, the liquid for forming coating and the ferrite particles are place din a vacuum degassing type kneader, and after stirring for 30 minutes at 60° C., toluene is distilled off at reduced pressure to form a coating on the surfaces of the ferrite particles, thereby a carrier is obtained.

The coating of the obtained carrier is uniformly dispersed with the carbon black and the crosslinked melamine resin particles. Because the coating material contains the perfluorooctylethyl acrylate copolymer as a matrix resin which is pre-dispersed with the carbon black particles and the crosslinked melamine resin particles by diluting with toluene by a sand mill.

| Production of carrier F: | |
|---|---|
| Ferrite particles (specific area 1150 $cm^2/g$, core material electric resistance $10^{7.80}$ Ω cm) | 100 parts |
| Toluene | 14 parts |
| Perfluorooctylethyl acrylate/methyl | 2.3 parts |

-continued

| Production of carrier F: | |
|---|---|
| methacrylate copolymer (copolymerization ratio 40:60, Mw = 50,000) | |
| Crosslinked melamine resin (mean particle diameter: 0.3 μm) | 0.3 part |
| Electrical-conductive particles (Pastran-type IV: made by Mitusi Mining & Smelting, barium sulfate particle coated with tin oxide) | 0.12 part |
| Crosslinked nylon resin (mean particle diameter: 0.3 μm) | 0.3 part |

The above components excluding the ferrite particles are dispersed by a homomixer for 10 minutes to prepare a liquid for forming coating, the liquid for forming coating and the ferrite particles are placed in a vacuum degassing kneader, and after stirring for 30 minutes at 60° C., toluene is distilled off at reduced pressure to form a coating on the surfaces of the ferrite particles, thereby a carrier is obtained.

The coating of the obtained carrier is uniformly dispersed with the carbon black and the crosslinked melamine resin particles and the closslinked nylon resin particles. Because the coating material contains the perfluorooctylethyl acrylate copolymer as a matrix resin which is pre-dispersed with the carbon black particles and the crosslinked melamine resin particles and the closslinked nylon resin particles by diluting with toluene by a sand mill.

| Production of carrier G: | |
|---|---|
| Ferrite particles (specific area 1620 $cm^2/g$, core material electric resistance $10^{8.0}$ Ω cm) | 100 parts |
| Toluene | 14 parts |
| Perfluorooctylethyl acrylate/methyl methacrylate copolymer (copolymerization ratio 40:60, Mw = 50,000) | 1.6 parts |
| Electric-conductive particles (S-1, made by Mitsubishi Materials, $SnO_2$) | 0.12 part |
| Crosslinked methyl methacrylate resin (mean particle diameter: 0.3 μm) | 0.3 part |

The above components excluding the ferrite particles are dispersed by a stirrer for 10 minutes to prepare a liquid for forming coating, the liquid for forming coating and the ferrite particles are placed in a vacuum degassing kneader, and after stirring for 30 minutes at 60° C., toluene is distilled off at reduced pressure to form a coating on the surfaces of the ferrite particles, thereby a carrier is obtained.

The coating of the obtained carrier is uniformly dispersed with the carbon black and the crosslinked methyl methacrylate resin particles. Because the coating material contains the perfluorooctylethyl acrylate copolymer as a matrix resin which is pre-dispersed with the carbon black particles and the crosslinked methyl methacrylate resin particles by diluting with toluene by a sand mill.

The properties of the carriers A to G described above are shown in Table 2 below.

TABLE 2

| Carrier name | Carrier core material properties: BET specific area ($cm^2/g$) | Carrier core material properties: Electric resistance | Carrier properties: Coating composition | Carrier properties: Apparent density ($g/cm^3$) | Carrier properties: Mean particle diameter ($\mu m$) | Carrier properties: $10/(D \times p) - S$ |
|---|---|---|---|---|---|---|
| A | 1000 | $10^{7.85}$ | PFA/MMA + St/MMA + carbon black + crosslinked melamine resin | 2.30 | 37.3 | 165 |
| B | 940 | $10^{8.81}$ | PFA/MMA + carbon black + crosslinked melamine resin | 2.25 | 37.8 | 176 |
| C | 985 | $10^{9.24}$ | PFA/MMA + $SnO_2$ + crosslinked methyl methacrylate resin | 2.2 | 37.0 | 101 |
| D | 750 | $10^{8.08}$ | PFA/MMA + barium sulfate-coated $SnO_2$ + crosslinked nylon resin | 2.4 | 42.4 | 233 |
| E | 340 | $10^{7.97}$ | PFA/MMA + carbon black + crosslinked nylon resin | 2.38 | 51.4 | 484 |
| F | 1150 | $10^{7.80}$ | PFA/MMA + barium sulfate-coated $SnO_2$ + crosslinked nylon resin | 1.85 | 36.5 | 331 |
| G | 1620 | $10^{8.00}$ | PFA/MMA + $SnO_2$ + crosslinked methyl methacrylate resin | 2.41 | 30.0 | −237 |
| H | 990 | $10^{7.68}$ | PFA/MMA + carbon black + crosslinked melamine resin | 2.28 | 37.1 | 192 |
| I | 990 | $10^{7.60}$ | PFA/MMA + carbon black + crosslinked melamine resin | 2.26 | 37.6 | 186 |

EXAMPLES 1 TO 5

Comparative Examples 1 to 3

By combining 6 parts each of the above-described toner particles A and B and 94 parts each of the above-described carriers A to G followed by mixing to prepare each developer. Using each of these electrostatic-charged image developers, a copying test is carried out using an electrophotographic copying machine (A-color 935, manufactured by Fuji Xerox Co., Ltd.). The results are shown in Table 3 below.

TABLE 3

| | Toner | Carrier | Initial charged amount ($\mu C/g$): High temp., high humidity | Initial charged amount ($\mu C/g$): Low temp., low humidity | Initial image quality (middle temp., middle humidity) | Charged amount after copying 100,000 copies ($\mu C/g$): High temp., high humidity | Charged amount after copying 100,000 copies ($\mu C/g$): Low temp., low humidity | Image quality after copying 100,000 copies: Graininess | Image quality after copying 100,000 copies: Pseudo profile gradation | Image quality after copying 100,000 copies: Density reproducibility | Image quality after copying 100,000 copies: Other image defects | Charging evaluation: Maintenance | Charging evaluation: Environmental difference | Total evaluation |
|---|---|---|---|---|---|---|---|---|---|---|---|---|---|---|
| Ex. 1 | A | A | −28 | −32 | good | −23 | −28 | no problem | no problem | no problem | no problem | ○ | ○ | |
| Ex. 2 | B | A | −28 | −35 | good | −22 | −30 | no problem | no problem | no problem | no problem | ○ | Δ | ○ |
| Ex. 3 | A | B | −28 | −30 | good | −22 | −27 | no problem | I | no problem | no problem | ○ | ○ | ○ |
| Ex. 4 | A | C | −24 | −28 | good | −17 | −22 | J | no problem | no problem | no problem | Δ | ○ | ○ |
| Ex. 5 | A | D | −20 | −26 | good | −16 | −21 | no problem | I | no problem | no problem | ○ | Δ | ○ |
| Comp. Ex. 1 | A | E | −1.9 | −25 | good | −13 | −21 | A | I | G | E | Δ | Δ | X |
| Comp. Ex. 2 | A | F | −24 | −31 | slightly foggy | −10 | −22 | A | B | F | D | X | Δ | X |
| Comp. Ex. 3 | A | G | −23 | −37 | good | −11 | −24 | A | I | F | E | X | X | X |

Ex.: Example
Comp. Ex.: Comparative Example

Then, a carrier the magnetic characteristics of which were controlled are prepared.

| Production of carrier H: | |
|---|---|
| Ferrite particles (sphere-converted specific area 0.0334 $m^2/g$, specific area 0.099 $m^2/g$, core material electric resistance $10^{7.88}$ Ω cm) | 100 parts |
| Toluene | 14 parts |
| Perfluorooctylethyl acrylate/methyl methacrylate copolymer (copolymerization ratio 40:60, Mw = 50,000) | 1.74 parts |
| Carbon black (VXC-72, made by Cabot Co.) | 0.28 part |
| Crosslinked melamine resin (mean particle diameter: 0.3 μm) | 0.23 part |

The above components excluding the ferrite particles are dispersed by a stirrer for 10 minutes to prepare a liquid for forming coating, the liquid for forming coating and the ferrite particles are placed in a vacuum degassing kneader, and after stirring for 30 minutes at 60° C., toluene is distilled off at reduced pressure to form a coating on the surfaces of the ferrite particles, thereby a carrier is obtained.

The coating of the obtained carrier is uniformly dispersed with the carbon black and the crosslinked melamine resin particles. Because the coating material contains the perfluorooctylethyl acrylate/methyl methacrylate copolymer as a matrix resin which is pre-dispersed with the carbon black particles and the crosslinked methyl methacrylate resin particles by diluting with toluene by a sand mill.

Production of Carrier I

By the same procedure as the case of producing carrier H except that the coating composition coating the ferrite particles in the production of the carrier H is changed to as described below, carrier particles I are obtained.

| | |
|---|---|
| Toluene | 18 parts |
| Perfluorooctylethyl acrylate/methyl methacrylate copolymer (copolymerization 40:60, Mw = 50,000) | 2.05 parts |
| Carbon black (VXC-72, made by Cabot Co.) | 0.32 part |
| Crosslinked melamine resin (mean particle diameter; 0.3 μm) | 0.26 part |

The properties of the carriers H and I are shown in Table 2 and Table 4 below.

TABLE 4

| | Carrier core material properties | | | | Carrier properties | | | | | |
|---|---|---|---|---|---|---|---|---|---|---|
| Carrier name | BET specific area $S_{cu}$ ($m^2/g$) | Sphere-converted specific area $S_{co}$ ($m^2/g$) | $S_{cu} - S_{co}$ | Electric resistance | Coating composition | Coating amount (%) | Mean particle diameter (μm) | Saturated magnetization emu/g | Residual magnetization emu/g | Coercive force Oe |
| H | 0.099 | 0.0334 | 0.0636 | 7.88 | PFA/MA + carbon black + crosslinked melamine resin | 2.18 | 37.1 | 56.4 | 0.60 | 6. |
| I | 0.099 | 0.0334 | 0.0636 | 7.88 | PFA/MA + carbon black + crosslinked melamine resin | 2.43 | 37.6 | 54.9 | 0.69 | 8.64 |

EXAMPLES 6 AND 7 by combining 6 parts each of the toner particles A and B and 94 parts each of the carriers H and I described above as shown in Table 5 followed by mixing to prepare each developer. Using each of these electrostatic-charged image developers, a copying test is carried out in the same way as Example 1. The results are shown in Table 5.

TABLE 5

| | | | Initial charged amount (μC/g) | | Initial image quality | Charged amount after copying 100,000 copies (μC/g) | | Image quality after copying 100,000 copies | | | | Charging evaluation | | |
|---|---|---|---|---|---|---|---|---|---|---|---|---|---|---|
| | Toner | Carrier | High temp., high humidity | Low temp., low humidity | (middle temp., middle humidity) | High temp., high humidity | Low temp., low humidity | Graininess | Pseudo profile gradation | Density reproducibility | Other image defects | Maintenance | Environmental difference | Total evaluation |
| Ex. 6 | B | H | −29 | −33 | good | −24 | −28 | no problem | no problem | no problem | no problem | ○ | ○ | |
| Ex. 7 | A | I | −20 | −25 | good | −16 | −20 | no problem | no problem | no problem | no problem | ○ | ○ | ○ |

The standards of each evaluation term in the examples described above are as follows.

(1) Evaluations of the Charged Amount and the Charging Property

The charged amount ($\mu$C/g) is measured by a blow off measurement apparatus. With regard to the charging property evaluation, a copying test at high temperature and high humidity (30° C., 90 RH %) and a copying test at low temperature and low humidity (10° C., 15 RH %) are carried out, and the environmental difference and the maintenance are obtained by the following formulae.

Environmental difference={initial charged amount (high temp., high humidity+low temp., low humidity)+charge after copying 100,000 copies (high temp., high humidity+low temp., low humidity)}×½

Maintenance=high temp., high humidity charged amount (100,000 copies+initial)+low temp., low humidity charged amount (100,000 copies+initial)}×½

The evaluation standards of the above-described environmental reliance are as follows. Incidentally, if above Δ, it is the level having no problem at practical use.

○: Environmental difference≧0.8

Δ: 0.6≦environmental difference<0.8 x: Environmental difference<0.6

The evaluation standards of the maintenance are as follows. Incidentally, if above Δ, it is the level having no problem at practical use.

○: Maintenance≧0.8

Δ: 0.6≦maintenance≦0.8 x: Maintenance<0.6

(2) Image Quality

With regard to the initial image quality, a chart having a density gradation is copied, the presence or absence of the gradation, uniformity of density, and an edge effect are visually evaluated.

With regard to the image quality after copying 100,000 copies, from the viewpoint of the graininess, gradation/pseudo profile, the density reproducibility, and other image defects, the evaluation thereof is carried out by the following standards. Incidentally, the cases of G to J are the levels having no problems at practical use.

No problem: After copying 100,000 copies, lowering of density and the formation of fog at the background portion are not occurred, and the image quality with excellent graininess and gradation is maintained.

A: With the passage of time, particularly under high temperature and high humidity, the image quality is deteriorated.

B: With the passage of time, particular under low temperature and low humidity, the deterioration of gradation due to the pseudo profile is observed.

C: By the deterioration of the charge maintenance, severe lowering of density and the occurrence of fog at the background portion are observed.

D: With the passage of time, particularly under low temperature and low humidity, unfilled points cause by scattering of the carrier occurred.

E: With the passage of time, particularly under low temperature and low humidity, the occurrence of fog at the background portion is noticable.

F: With the passage of time, particular under high temperature and high humidity, the occurrence of uneven density becomes severe.

G: With the passage of time, particular under high temperature and high humidity, the density tends to lower but it gives no problem in the image quality.

H: With the passage of time, due to the deterioration of charging by the environmental difference, fog is slightly formed at the background portion of the image.

I: With the passage of time, edge effect is observed a little.

J: Image quality degraded a little but it is a level of causing no problem at practical use.

As is clear from Tables 3 and 5, in the case of the examples using the developers each containing the carrier of the invention, even in repeated copying, images excellent in the charging stability with the passage of time, the environmental reliability, the gradation of image quality, the graininess, and the density reproducibility were obtained as compared with the comparative examples. Furthermore, in Examples 6 and 7 wherein the magnetic characteristics are controlled, it is found that the gradation and the environmental characteristics are improved as compared with Examples 2 and 3 using corresponding carrier and toner. As described above, it is confirmed that by using the developer containing the carrier of this invention, images having excellent image quality can be formed for a long period of time and further it is found that by controlling the magnetic characteristics, the effects are improved.

Regeneration of Carrier Core Material

Using the developer A used in Example 1 described above, a copy test is carried out by an electrophotographic copying machine (A-color 935; manufactured by Fuji Xerox Co., Ltd.). After copying 200,000 copies, the deteriorated developer A is recovered. After confirming the impaction using fluorescent X ray (LAB-CENTER: XRF 1500, manufactured by Shimazu Corp.), the carrier is separated from the toner. There is no particular restriction on the separation method in this case, and they can be separated by a blow off method, an air classification method, a water-washing method, etc. The separated stained (impaction) carrier is defined as carrier A'.

Production of Regenerated Carrier J

By forming a coating by the same procedure as in the case of obtaining carrier A except that using carrier core material j obtains from the carrier A' through a regeneration step wherein the combustion temperature of the 1st step is controlled at 550° C., the combustion temperature of the 2nd step is controlled at 1200° C. and the oxygen atmosphere concentration of the 2nd step is controlled at 5%, regenerated carrier particles J are obtained.

Production of Regenerated Carrier K

By forming a coating by the same procedure as in the case of obtaining carrier A except that using carrier core material k obtains from the carrier A' through a regeneration step wherein the combustion temperature of the 1st step is controlled to 600° C., the combustion temperature of the 2nd step is controlled to 800° C. and the oxygen atmosphere concentration of the 2nd step is controlled at 10%, regenerated carrier particles K are obtained.

Production of Regenerated Carrier L

By forming a coating by the same procedure as in the case of obtaining carrier A except that using carrier core material 1 obtains from the carrier A' through a regeneration step wherein the combustion temperature of the 1st step is controlled at 200° C., the combustion temperature of the 2nd step is controlled at 800° C. and the oxygen atmosphere concentration of the 2nd step is controlled at 10%, regenerated carrier particles K are obtained.

Production of Regenerated Carrier M

By forming a coating by the same procedure as the case of obtaining carrier A except that using carrier core material m obtains from the carrier A' through a regeneration step wherein the combustion temperature of the 1st step is controlled at 600° C., the combustion temperature of the 2nd step is controlled at 800° C., regenerated carrier particles M are obtained.

The regeneration conditions of the carrier particles are shown in Table 6 below.

TABLE 6

| | Conditions of regeneration step: | | | | |
|---|---|---|---|---|---|
| | | | Regeneration step | | |
| | | | | 2nd step | |
| | Carrier | Carrier core material | 1st step Burning temperature (° C.) | Burning temperature (° C.) | Oxygen atmosphere concentration control |
| Example 1 | A | Non-regenerated product | — | — | — |
| Example 8 | J | j | 550 | 1200 | made (5%) |
| Example 9 | K | k | 600 | 800 | made (10%) |
| Comp. Ex. 4 | L | l | 200 | 800 | made (10%) |
| Comp. Ex. 5 | M | m | 800 | 800 | none |

EXAMPLES 8 AND 9

Comparative Examples 4 and 5

By combining 6 parts of the toner particles A used in Example 1 and 94 parts each of the regenerated carriers J to M described above follows by mixing, each developer is prepared. Using each of these electrostatically charged image developers, a copying test is carried out by an electrophotographic copying machine (A-color 935, manufactured by Fuji Xerox Co., Ltd.). The results are shown in Table 7.

The evaluation terms in the examples of the comparative examples are the same as those in Example 1 described above.

TABLE 7

| | Evaluation results: | | | | | |
|---|---|---|---|---|---|---|
| | | | Charged amount ($\mu$C/g) | | Image quality evaluation | |
| | Carrier | Toner | At initiation of test | After copying 200,000 copies | At initiation of test | After copying 200,000 copies |
| Example 1 | A | A | -25.3 | -22.0 | no problem | no problem |
| Example 8 | J | A | -28.7 | -24.0 | no problem | no problem |
| Example 9 | K | A | -23.2 | -22.5 | no problem | no problem |
| Comp. Ex. 4 | L | A | -37.1 | -18.5 | *2 | *1 |
| Comp. Ex. 5 | M | A | -23.3 | -20.1 | no problem | *3 |

*1: Fog at background portion
*2: Density lowered
*3: Image defects such as edge effect, pseudo profile, etc.

As is clear from Table 7, it has been confirmed that in the case of Examples 6 and 7 applied with the regeneration method of the invention, the same developer characteristics as Example 1 (non-regenerated product core material). Also, in comparative Example 4 wherein the burning temperature condition is outside the preferred range and Comparative Example 5 wherein the oxygen atmosphere concentration is not controlled in the 2nd step, image quality defects such as the formation of fog at the background portion, density lowering, pseudo profile or the like have been confirmed.

As described above in detail, according to the present invention, the carrier suitable for electrostatic charge developer, which can impart a stable charging property with the passage of time to the developer and does not cause fog and density lowering, and the two-component developer using it can be obtained. Also, by using the developer, an image-forming process capable of forming stable images with the passage of time for a long period of time can be provided.

The developer of this invention has excellent effects of being suitable for the color image formation that even when continuous copying of an original having a large image area such as photographs and pictures is conducted, the density reproducibility is stable and a toner spent does not occur in the developing machine.

Also, according to the regeneration method of carrier core material of the invention, the carrier core material for electrostatic charge developer capable of imparting a stable charging property with the passage of time to the developer can be regenerated without degrading the characteristics thereof.

What is claimed is:

1. A carrier for two-component electrostatic-charged image developer, comprising a carrier core and a coating resin, wherein the apparent density ρ (g/cm$^3$) of the carrier, the mean particle diameter D (cm) of the carrier, and the specific area S (cm$^2$/g) of the carrier core satisfy the following formulas:

$$600 \leqq s \leqq 1500$$

$$10/(D \times \rho) - S \leqq 300.$$

2. The carrier according to claim 1, wherein the mean particle diameter is approximately from 30 to 45 $\mu$m.

3. The carrier according to claim 1, wherein a saturation magnetization of the carrier under an applied magnetic field of 1000 Oe (Oersted) is approximately from 50 to 65 emu/g.

4. The carrier according to claim 1, wherein a residual magnetization of the carrier is not larger than 3 emu/g and a coercive force of the carrier is not larger than 12 Oe under an applied magnetic field of 1000 Oe (Oersted).

5. The carrier according to claim 1, wherein a sphere-converted specific area $S_{co}$ (m$^2$/g) of a particle diameter of the carrier core and a BET surface area $S_{ca}$ (m$^2$/g) of a material of the core satisfy the following formula:

$$0.057 \leqq S_{ca} \cdot S_{co} \leqq 0.097.$$

6. The carrier according to claim 1, wherein an electric resistance of the core is approximately from $10^{7.5}$ to $10^{9.5}$ Ω cm.

7. The carrier according to claim 1, wherein the coating resin contains at least one of resin particles and electrically conductive particles.

8. A two-component developer comprising:

the carrier according to claim 1; and a toner having a volume mean particle diameter of approximately from 5 to 9 $\mu$m.

9. The two-component developer according to claim 8, wherein a particle size distribution of the toner is that the number of toner particles having a particle diameter of not more than 4 $\mu$m is approximately from 6 to 25% of the total number of toner particles, and the amount of toner particles having a particle diameter of not less than 16 $\mu$m is approximately not more than 1 volume %.

10. The two-component developer according to claim 8, wherein an electric resistance of the core is approximately from $10^{7.5}$ to $10^{9.5}$ Ω cm.

11. The two-component developer according to claim 8, wherein the toner contains inorganic particles having a BET surface area of approximately from 40 to 250 m$^2$/g.

12. An image-forming process, comprising:

forming a latent image on a latent image holding member; and developing the latent image using the two-component developer according to claim 8 on the developer holding member.

13. A regeneration method of a core of a carrier including a core and a coating layer, comprising:

removing the coating layer of the carrier by burning the carrier at a combustion temperature of approximately from 500° C. to 1300° C.; and firing the carrier at a firing temperature of approximately from 500° C. to 1300° C. while controlling an oxygen atmosphere concentration to make the core have predetermined core characteristics again.

* * * * *